US012618175B2

(12) United States Patent
Wallace et al.

(10) Patent No.: US 12,618,175 B2
(45) Date of Patent: May 5, 2026

(54) APPARATUS AND METHOD FOR CLOSE PROXIMITY CARBONIZATION OF POLYMERIC MATERIALS FOR CARBON FIBER PRODUCTION

(71) Applicants: William W. Wallace, North Dighton, MA (US); Hippolyte A. Grappe, Oak Ridge, TN (US); Felix L. Paulauskas, Knoxville, TN (US); H. Felix Wu, Frederick, MD (US); Truman Bonds, Knoxville, TN (US)

(72) Inventors: William W. Wallace, North Dighton, MA (US); Hippolyte A. Grappe, Oak Ridge, TN (US); Felix L. Paulauskas, Knoxville, TN (US); H. Felix Wu, Frederick, MD (US); Truman Bonds, Knoxville, TN (US)

( * ) Notice: Subject to any disclaimer, the term of this patent is extended or adjusted under 35 U.S.C. 154(b) by 870 days.

(21) Appl. No.: 17/902,815

(22) Filed: Sep. 3, 2022

(65) Prior Publication Data

US 2024/0076808 A1 Mar. 7, 2024

(51) Int. Cl.
*D01F 9/32* (2006.01)

(52) U.S. Cl.
CPC ..... *D01F 9/32* (2013.01)

(58) Field of Classification Search
CPC ..... D01F 9/32; D01F 9/14
See application file for complete search history.

(56) References Cited

U.S. PATENT DOCUMENTS 3,607,062 A * 9/1971 Sudduth ..... C10L 9/08 432/15
4,197,282 A 4/1980 Bailly-Lacresse et al.
6,372,192 B1 * 4/2002 Paulauskas ..... D01F 9/12 423/447.7
6,375,875 B1 * 4/2002 Paulauskas ..... G01N 22/00 425/464
6,514,449 B1 * 2/2003 Paulauskas ..... B29C 70/54 264/483
7,824,495 B1 * 11/2010 White ..... D06M 10/025 118/723 MW (Continued)

OTHER PUBLICATIONS

Definition of "tunable," accessed online at https://www.merriam-webster.com/dictionary/tunable on Jul. 11, 2025 (Year: 2025).*

(Continued)

*Primary Examiner* — Daniel C. McCracken
(74) *Attorney, Agent, or Firm* — Robert J. Lauf

(57) ABSTRACT

An apparatus and method for the low temperature carbonization of a continuous tow of polymeric material fiber, such as PAN or other carbon fiber precursor materials at atmospheric pressure in an inert gas (usually nitrogen or argon) is disclosed. A pair of antennas are arranged within an electromagnetic cavity and face each other in an edgewise fashion for direct electromagnetic heating of the fiber tow as it passes between them. Supplemental background heating increases the dielectric loss of the fiber tow in order to improve absorption of electromagnetic energy and prevent arcing. The invention produces a higher density low temperature carbonized fiber in a shorter residence time compared to conventional low temperature carbonization.

20 Claims, 11 Drawing Sheets

(56) References Cited

U.S. PATENT DOCUMENTS

| | | | |
|---|---|---|---|
| 9,427,720 | B2 | 8/2016 | White et al. |
| 2020/0056306 | A1 | 2/2020 | Kim et al. |
| 2021/0115598 | A1 | 4/2021 | Shin et al. |

OTHER PUBLICATIONS

Lebedev, Some properties of the tunable cavity microwave plasma source, Plasma Sources Sci. Technol. 1995; 4: 474-481 (Year: 1995).*

Peebles, L. H. "Carbon Fibers—Formation, Structure, and Properties" CRC Press, 1995, pp. 7-25 and 128-135.

Donnet, J.-B., et al. "Carbon Fibers" Third Ed., Marcel Dekker Inc., 1998, pp. 26-31.

Morgan, P. "Carbon Fibers and Their Composites" CRC Taylor and Francis, 2005, pp. 200-203.

Paulauskas, F. L. et al., "Temperature-Dependent Dielectric Measurements of Polyacrylonitrile Fibers during Air Oxidation" SAMPE 2004, May 16-20, Long Beach, CA.

* cited by examiner

APPARATUS AND METHOD FOR CLOSE PROXIMITY CARBONIZATION OF POLYMERIC MATERIALS FOR CARBON FIBER PRODUCTION

STATEMENT REGARDING FEDERALLY SPONSORED RESEARCH

This invention was made with Government support under Contract No. DE-AC05-00OR22725 awarded by the U. S. Department of Energy to UT-Batelle LLC, and the Government has certain rights in this invention.

BACKGROUND OF THE INVENTION

Field of the Invention

The invention pertains to apparatus and methods for manufacturing carbon fiber, and more particularly, to apparatus and methods for carbonizing polymeric fibers using near-field electromagnetic treatment.

Description of Related Art

Carbon fiber is a material with very high specific stiffness and strength, hence is very attractive for weight-critical applications. However, it comes at a high cost, so it is typically used in structures in which weight reduction justifies the high cost premium. Carbon fiber is also very attractive for use in heavy vehicles and automotive passenger platforms as well as in other industries where its use offers weight reduction and energy efficiency gains. However, the production of carbon fiber is lengthy and expensive. It is estimated that to be massively adopted in those industries, the price of carbon fiber must be reduced by approximately half. It is generally observed that commercial grade carbon fiber production cost is about evenly divided between the cost of the precursor and the cost of converting the precursor to carbon fiber. The low temperature carbonization stage is one of the most energy intensive process steps. Significantly reducing the energy consumption of low temperature carbonization (LTC) per unit mass would allow the carbon fiber to be one step closer to broader adoption in the industry.

FIG. 1 shows a diagram of all steps encountered by the material in a conventional line of conversion as in the current industry: pre-treatments, stabilization/oxidation, low temperature carbonization, high temperature carbonization, graphitization (optional), surface treatment, and sizing. The low temperature carbonization (outlined by the dashed line in FIG. 1) is the first step of carbonization, where major morphological changes occur and where most of the effluent is released, leaving behind a high percentage of carbon containing fiber.

Carbon fiber is produced from a variety of precursors. The predominant raw materials are polyacrylonitrile (PAN), mesophase pitch, and rayon. Natural precursors such as cellulose or lignin also exist but are not commonly used in the industry. In most cases, the precursor is spun in tows of continuous filaments. Then it may be pre-stretched before being stabilized in an oxidative environment (usually in air at 200° C.-400° C. for several hours, depending upon the precursor) [see Peebles L. H., "Carbon Fibers-Formation, Structure, and Properties", CRC Press, pp. 7-25 and 128-135 (1995)]. After the stabilization process, the material becomes a thermoset. It is matte black, infusible, flameproof, and is usually referred to as "oxidized fiber". This oxidized fiber is sufficiently stable for exposure to significantly higher carbonization temperatures and graphitization under an inert environment, usually nitrogen. The carbonization process is divided into two or three stages. The first carbonization stage is LTC and operates in the 350° C.-800° C. temperature range. The second carbonization stage is high temperature carbonization (HTC). This second stage thermally treats the fiber between 800° C. and 1500° C. [see Donnet, J.-B. et al., "Carbon Fibers", Third Edition, Marcel Dekker, Inc., pp. 26-31 (1998)].

Optionally, carbon fiber can be given an additional thermal treatment between 2000° C. and 3000° C., referred to as graphitization. In this last stage the fiber acquires a graphite-like structure while losing almost all its impurities and experiencing a negligible weight variation. To some extent, the Young's modulus is function of the highest temperature the fiber has been exposed during the graphitization stage [see Morgan, P., "Carbon Fibers and their Composites", CRC Taylor and Francis, pp. 200-203 (2005); and Donnet, J.-B. et al., "Carbon Fibers", Third Edition, Marcel Dekker, Inc., p. 29 (1998)]. Thus graphitization produces carbon fiber with extremely high stiffness.

Once the material is fully carbonized, the carbon fiber's surface is conditioned to obtain the final product by dipping it in an electrolytic or acidic bath. The fiber, configured as an anode, travels between cathodes made of graphite. Finally, the tow is coated with a sizing for handleability and packaging purposes.

Electromagnetic (EM) energy sources, i.e. microwave, for material processing and carbon fiber conversion have been used since the 1970s. The application and the efficiency of EM as an energy source is highly dependent on the design of the processing chamber, power transmission line, the geometry of the antenna system relative to the load, modes, pattern of radiation, management and control of the energy inside the chamber (i.e., control of reflections), yield efficiency, sustainability, resonance, and in general, the overall configuration of the hardware processing system.

Among the earliest work using EM energy source for carbon fiber precursor conversion is reported in the Japanese Pat. Specification No. 4724186, published on Jul. 4, 1972, and natural organic spun material in a batch mode (U.S. Pat. No. 4,197,282, Lacress, et al.). Since then, this energy source has been researched significantly, but never put into commercial production.

Since 2000, the Oak Ridge National Laboratory has been issued several patents related to the carbonization of carbon fiber precursors using a microwave plasma (MW) generated in vacuum. U.S. Pat. No. 6,372,192 to Paulauskas, et al. describes the carbonization of material batches wrapped around a static frame exposed to a plasma. U.S. Pat. No. 6,375,875 to Paulauskas, et al. discloses a technique that uses frequency sweeping in the microwave band to characterize carbon fiber. In addition to using EM power to carbonize material, the dielectric properties of fiber can be measured by radiating with low power EM energy and analyzing the reflected power. In this case, MW energy is not used to convert the polymer into carbon fiber.

U.S. Pat. No. 9,427,720 to White, et al. describes a process of comprehensive carbonization for multiple tows in one single stage using plasma generated by MW under vacuum. The oxidized PAN fiber (OPF) material is exposed to a gradient of MW power in an elongated cavity in a low pressure gas. This cavity features two eyelets, one on each end, so that OPF is fed in one end and processed fiber (carbonized CF) exits at the other end. This cavity is subjected to a moderate vacuum. Part of the gas effluent generated while the fiber undergoes thermal conversion is utilized as a plasma working gas to reduce the consumption of nitrogen. Because of the gradient of MW energy along the cavity, the plasma is heterogeneous: the plasma has a higher density toward the exit of the process, whereas, on the entrance side, where the OPF is introduced, the plasma is almost nonexistent. In this region, the MW is predominant. This system has the capability of processing multiple tows simultaneously.

Recently U.S. Pat. Appl. Pub. Nos. 2020/0056306 to Kim, et al., and 2021/0115598 to Shin, et al. disclose an apparatus in which a single tow is processed by direct exposure to the MW through a single port and the system further uses a MW susceptor inside a non-resonant cavity.

Objects and Advantages

Objects of the present invention include the following: providing an apparatus for low temperature carbonization of a continuous fiber tow using electromagnetic energy; providing an apparatus for low temperature carbonization of a continuous fiber tow using electromagnetic energy with supplemental convective heating; providing an apparatus for low temperature carbonization of a continuous fiber tow that yields improved density and reduces processing time; providing an apparatus for carbonization of a continuous fiber tow using electromagnetic energy that provides not only low temperature carbonization but also some high temperature carbonization; and, providing a more efficient process for carbonization of a continuous fiber tow. These and other objects and advantages of the invention will become apparent from consideration of the following specification, read in conjunction with the drawings.

SUMMARY OF THE INVENTION

According to one aspect of the invention, an apparatus to partially carbonize stabilized carbon fiber precursor materials includes:

- a source of electromagnetic energy of a selected power and frequency;
- a tunable resonant cavity including an antenna structure to localize the electromagnetic energy on the precursor material;
- openings in both ends of the cavity, so that the precursor material passes through the cavity as a continuous fiber tow in a selected atmosphere at ambient pressure; and,
- a system to control the thermal background of the process to increase the permittivity of the precursor material so that the material will absorb the electromagnetic energy.

According to another aspect of the invention, an apparatus to partially carbonize stabilized carbon fiber precursor materials includes:

- a source of electromagnetic energy of a selected power and frequency;
- a tunable resonant cavity including an antenna structure to localize the electromagnetic energy on the precursor material;
- a dielectric tube disposed within the antenna structure, through which the precursor material passes as a continuous fiber tow in a selected atmosphere at ambient pressure; and,
- a system to control the thermal background of the process to increase the permittivity of the precursor material so that the material will absorb the electromagnetic energy.

According to another aspect of the invention, a process to partially carbonize stabilized carbon fiber precursor materials includes:

- providing a source of electromagnetic energy of a selected power and frequency;
- providing a tunable resonant cavity including an antenna structure to localize the electromagnetic energy on the precursor material;
- passing stabilized carbon fiber precursor material through the resonant cavity and through the antenna structure so that the precursor material is exposed to the electromagnetic energy in the selected atmosphere; and,
- controlling the thermal background of the process to increase the permittivity of the precursor material so that it will absorb the electromagnetic energy.

According to another aspect of the invention, a process to partially carbonize stabilized carbon fiber precursor materials includes the steps of:

- providing a source of electromagnetic energy of a selected power and frequency;
- providing a tunable resonant cavity including an antenna structure to localize the electromagnetic energy on the precursor material;
- providing a dielectric tube disposed within the antenna structure, in which a selected atmosphere is maintained at ambient pressure;
- passing stabilized carbon fiber precursor material through said dielectric tube so that it is exposed to the electromagnetic energy in the selected atmosphere; and,
- controlling the thermal background of the process to increase the permittivity of the precursor material so that it will absorb the electromagnetic energy.

According to another aspect of the invention, a process to manufacture carbon fiber includes the steps of:

- supplying a continuous tow of a carbon fiber precursor material;
- passing the precursor through a stabilization and oxidation process chamber to yield a stabilized oxidized precursor material;
- passing the stabilized precursor material through a low temperature carbonization process, the process comprising:
  - providing a source of electromagnetic energy of a selected power and frequency;
  - providing a tunable resonant cavity including an antenna structure to localize the electromagnetic energy on the precursor material;
  - providing a dielectric tube disposed within the antenna structure, in which a selected atmosphere is maintained at ambient pressure;
  - passing stabilized carbon fiber precursor material through said dielectric tube so that it is exposed to the electromagnetic energy in the selected atmosphere; and,
  - controlling the thermal background of the process to increase the permittivity of the precursor material so that it will absorb the electromagnetic energy;
- passing the stabilized precursor material through a high temperature carbonization process;
- optionally passing the high temperature carbonized fiber through a graphitization process;
- optionally providing additional surface treatment; and,
- optionally, applying sizing to the carbonized fiber tow.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting embodiments illustrated in the drawing figures, wherein like numerals (if they occur in more than one view) designate the same elements. The features in the drawings are not necessarily drawn to scale.

DETAILED DESCRIPTION OF THE INVENTION

Figure 1:
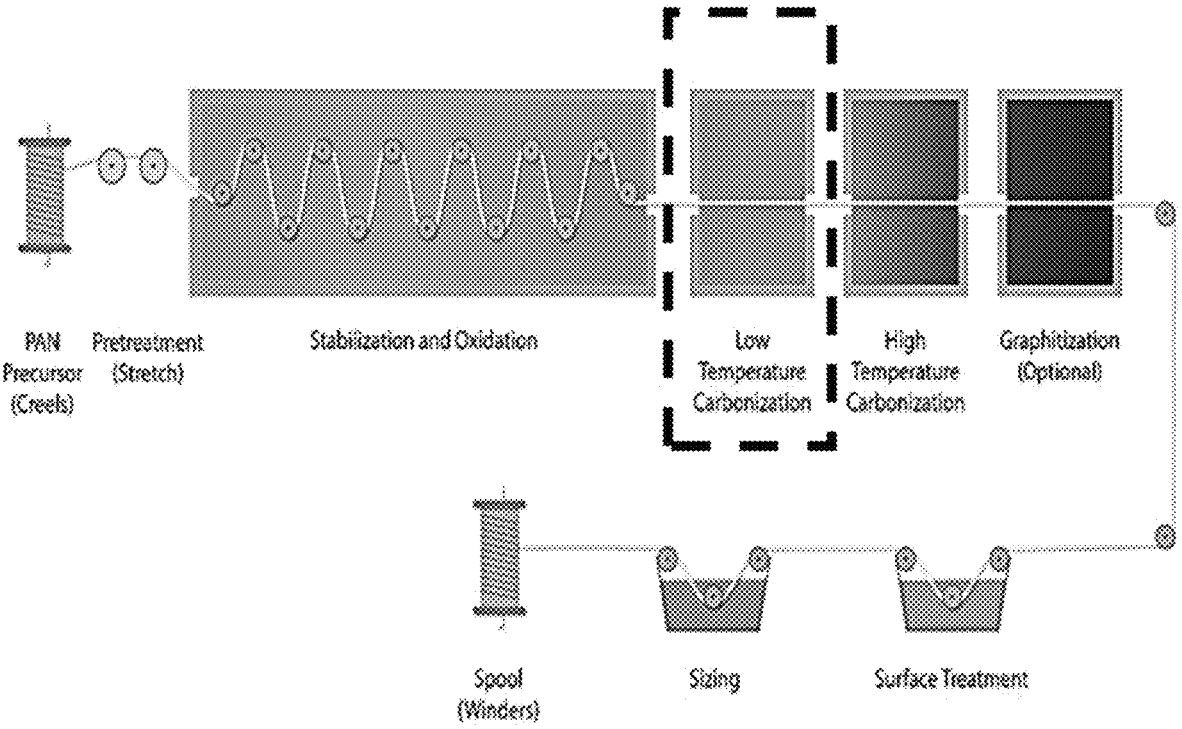
FIGURE 1 PRIOR ART
FIG. 1 is a schematic diagram of conventional carbon fiber processing steps according to the Prior Art.

The present invention aims to replace the existing low temperature carbonization (LTC) furnaces in an industrial conversion line, but a traditional high temperature carbonization (HTC) step is still required to produce carbon fiber with the desirable mechanical properties. However, Applicants have discovered that the invention is able to effect processing not only in the LTC regime, but also partway into the HTC regime, so that in the subsequent processing step, the HTC furnace may be smaller than what is traditionally specified. Two main differences between the invention and the technique currently used in the industry are its energy source and the configuration of the processing cavity. The invention uses energy from both electromagnetic (EM) power and conventional convective heating to convert the material, with the electromagnetic power being dominant. By contrast, in current industry practice, conventional furnaces use radiative heating alone.

This invention establishes a new method and apparatus for modifying bulk and surface properties of stabilized polymeric materials, including PAN fiber. As described above, previous inventions were developed for the carbonization of PAN via MW processing techniques. In this distinctly new method, called Close Proximity Electromagnetic Carbonization (CPEC), the energy source is fed into a chamber through an antenna system that exists near but not in direct contact with the workpiece. No vacuum is required. Carbonization is performed at atmospheric pressure in an inert environment (preferably nitrogen or argon, but not limited to those two gases). This approach has led to significant improvements in required processing time, energy usage, and fiber properties. The goal of the CPEC technology was to create a novel LTC stage based on an EM energy source. This approach is potentially more cost effective than the existing conventional radiative furnaces for implementation in carbon fiber production lines.

A key aspect of the invention is based on Applicants' recognition of the proper use of the dielectric properties and coupling characteristics of the material to be processed. These dielectric characteristics must be well known and controlled to achieve the required acceptable level of coupling of EM energy to the material/fiber that will be processed (i.e., the energy deposition into the material). For background purposes, an illustration of the measurement of the dielectric characteristics of oxidized PAN fiber and how they change with temperature is shown in FIG. 2, and a short explanation will follow.

In the present invention, a pair of antennas are placed at the center of a set of reflectors defining a resonant cavity. This geometry aims to focus the EM energy and generate strong E field regions along the tow of oxidized PAN fiber (OPF). Despite this favorable configuration, spontaneous dielectric heating is impossible if the process starts at room temperature. As shown in FIG. 2, the permittivity of the material at that temperature is too low for direct coupling. However, the material becomes lossier at a high temperature and thus couples better with EM energy. As with many materials, above a certain temperature the loss tangent begins to rise exponentially. This is favorable for efficient energy deposition. For PAN precursor, this temperature has been identified as around 400° C. It has been found, with the inventive cavity, that a thermal background of 350° C. is sufficient to obtain an acceptable level of coupling with the energy source and obtain the desired conversion efficiency. An important issue with this process is how this energy is delivered and spatially distributed together with a proper selection of the process parameters (e.g., fiber line speed).

Example

Figure 2:
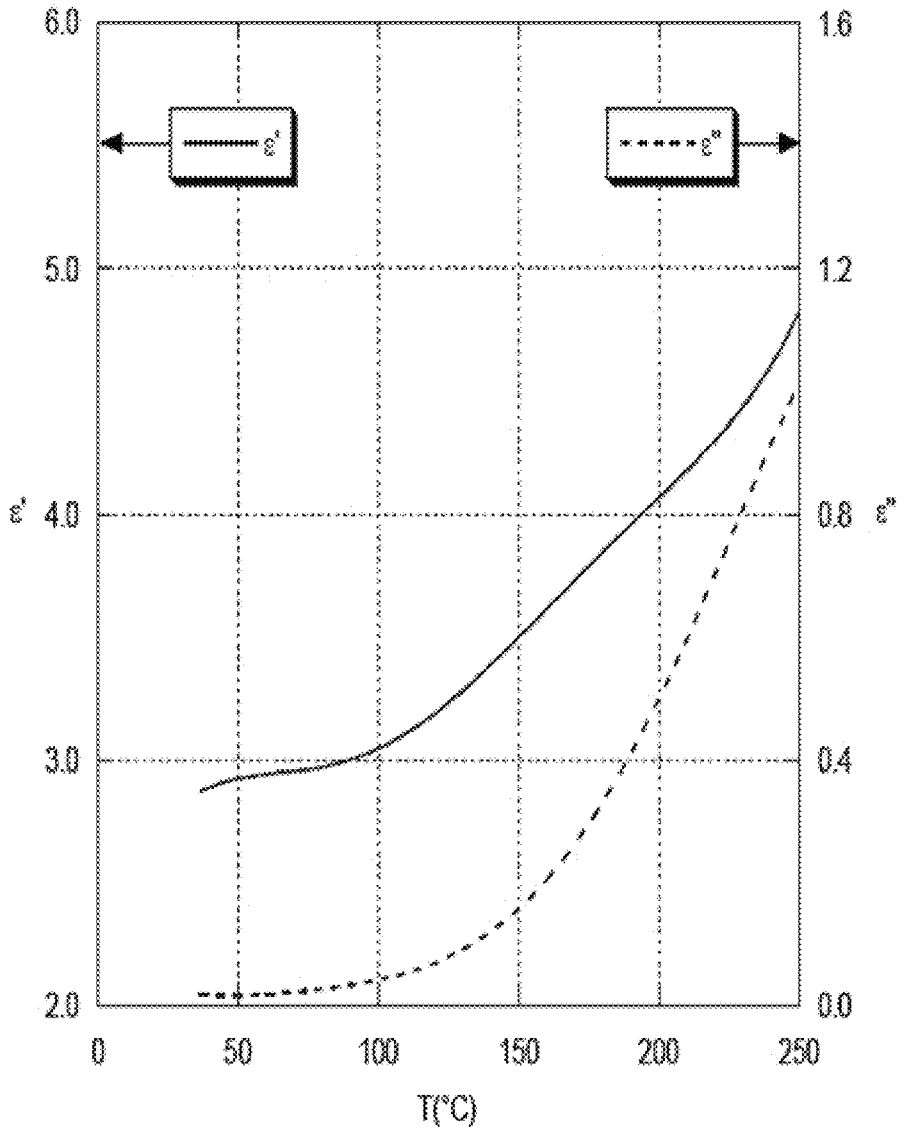
FIGURE 2 PRIOR ART
FIG. 2 is a plot of the permittivity/dielectric properties of oxidized PAN material at 2.45 GHz as a function of temperature [see "Temperature-Dependent Dielectric Measurements of Polyacrylonitrile Fibers during Air Oxidation," F. L. Paulauskas and T. L. White, presented and published at SAMPE 2004, May 16-20, 2004, Long Beach, CA].

As an example, a calculation of the tan δ, which is an indication of how lossy the material is to EM excitation, using FIG. 2 and defined as $\tan \delta = \varepsilon''/\varepsilon'$, shows the significant increase of 30× of this property between 50° C. and 250° C. Thus, the material becomes 30 times lossier at 250° C. versus 50° C., which is a positive characteristic exploited by the present invention.

TABLE 1

Calculation of tan δ (at 2.45 GHz) for oxidized PAN material based on the values of ε' and ε" (farad/m) at 50° C. and 250° C.; data from measurements reported in FIG. 2.

| Temperature, ° C. | ε', F/m | ε", F/m | tan δ |
|---|---|---|---|
| 50 | 2.9 | 0.02 | 0.0069 |
| 250 | 4.8 | 1.00 | 0.2083 |

Design Integration Overview

The concept of the invention is based on coupling OPF or other types of stabilized fiber with a MW energy source at atmospheric pressure without modifying or preconditioning the feedstock material. The goal is to obtain partial, or low temperature, carbonization of the fiber, which is generally defined as processing up to around 800° C. where the majority of non-carbon elements are removed.

In the current design, a single tow of OPF (with 50 k filaments) passes through a closed cavity through narrow end slits and is exposed to a high intensity electromagnetic field. The entire cavity with the excitors and its subsystem is referred to as the applicator 1. Computer electromagnetics (CEM) modeling is used to predict the matching between the generator and the load as well as the EM field distribution in the entire applicator as a function of multiple parameters. The design aims to concentrate the EM energy along the tow path or in its near vicinity.

The design comprises several subsystems: 1. an applicator (the cavity or process chamber, with its set of antennas); 2. a system for providing a heated atmosphere; 3. a MW power source with its transmission line; and 4. a fiber delivery system. These subsystems are described in detail in the following sections.

The Microwave Applicator

The applicator 1 is a single resonant cavity that could be expanded to multiple arrayed chambers in series or parallel. Schematic views of an applicator are shown in FIGS. 4-7. The resonant cavity is built with two parabolic reflectors 61, 62 facing each other delimited by two vertical walls 63, 64. One antenna 65 is placed in the center of each reflector. The distance between the antennas is large enough to leave sufficient space for the fiber tow 42 and, if needed, an insert tube 43 of arbitrary cross section but with a size that can fit inside the applicator between the antennas and surrounding the fiber tow. If such an insert is used, its material selection must take into account its coupling properties at the temperature and in the band of operation. It is preferably substantially transparent to the electromagnetic energy field. The vertical walls 63, 64 that delimit each end of the cavity have a slit 51 allowing the fiber to go in on one end of the cavity and come out on the other. One wall can be fixed and the other adjustable, thereby allowing for fine tuning of the cavity. This chamber has the characteristics of showing two planes of symmetry defined by the normal vectors $N_y$ and $N_z$. For description and orientation purposes, we define the coordinate system with the origin O being at the center of the applicator, and the following vectors: X is a horizontal vector pointing in the direction of the fiber propagation, Y is pointing perpendicularly to the left of the fiber but still in the horizontal plane, and Z is defined as the cross product Z=X×Y (the resulting vector is the vertical pointing upward). Because the position of the vertical wall 63 on the entry side is adjustable, the length of the processing cavity is not fixed. Furthermore, the antennas 65 have two defined locations at equal distances from the center O of the applicator on the Z axis and can only be adjusted along this same axis. Based on these two characteristics (fixed position of the antennas on X and Y axes, and the vertical wall 63 at the entrance that can slide along the X axis), the process chamber is asymmetric through the vertical plane defined by the normal vector $N_x$.

The shape of the cavity is defined by four surfaces only. Two of those surfaces are determined by the curved reflectors while the other two are vertical walls. The two reflectors 61, 62 face each other and forming a symmetric configuration based on the plane defined by the normal vector $N_z$. Their shape is preferably a concave paraboloid translated along X. They have the same length and are terminated on each end by a straight vertical plane defined by its normal vector $N_x$. The resulting configuration of these surfaces creates a cavity whose top and bottom are delimited by the concave paraboloid surfaces of both reflectors. At the beginning and the end of that cavity, the two remaining sides are delimited by vertical walls 63, 64 (one being adjustable along X).

Figure 9:
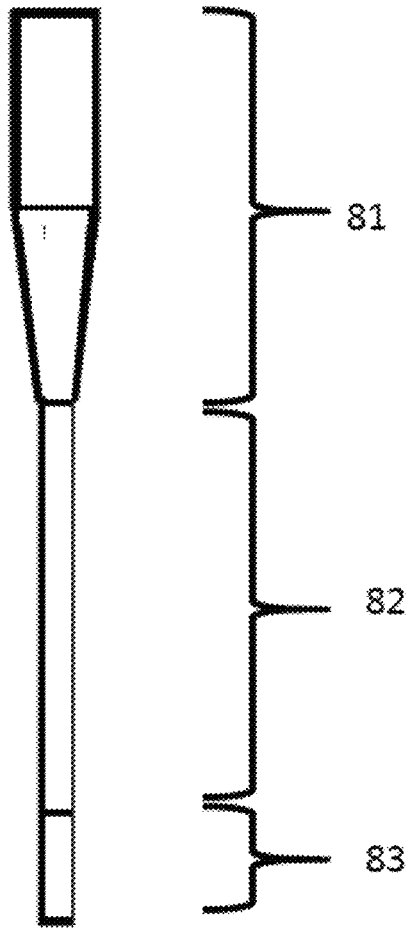
FIG. 9 presents a side view of one antenna viewed in the plane normal to that of FIG. 8B in accordance with some aspects of the invention. It can be seen that in this case, the thickness of the fan-shaped end is the same as the thickness of the supporting rod.
Figure 10:
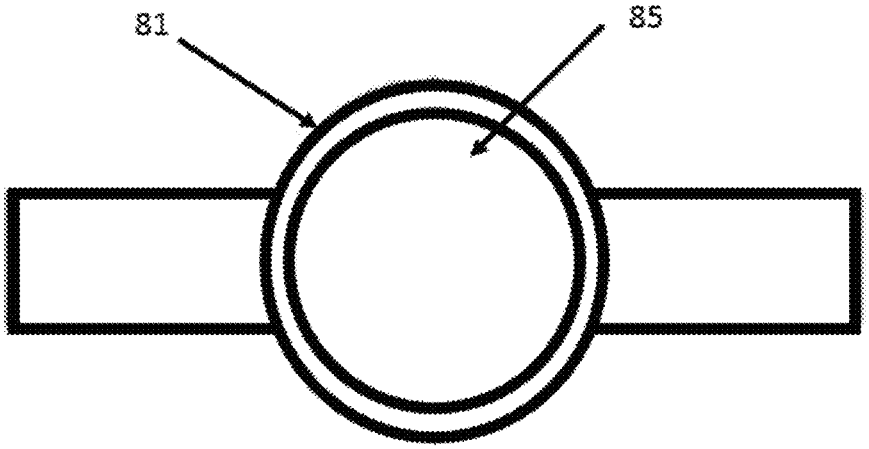
FIG. 10 presents a top view of one antenna in accordance with some aspects of the invention.

The pair of antennas 75 are located at the center of the applicator, symmetrically, along the Z axis. The antennas are composed of three metal parts: a cylindrical connector 81 (female) that has a tapered section allowing for an outer diameter reduction; a cylindrical standoff 82 allowing for length adjustment by replacement of this part; and a radial part 83 acting as an antenna. This antenna set is depicted schematically in FIG. 8 with its mounting system. Side and top view, without their mounting systems, are shown in FIGS. 9 and 10.

In the cavity illustrated, the reflectors were cut from stainless steel blocks. This approach created a robust structure that retained a stable shape during fabrication and use. Nonetheless, it will be appreciated that other suitable fabrication methods are well known and may be used depending on considerations such as size, production quantities, and cost factors.

The System for Providing a Heated Atmosphere

To conserve nitrogen, an insert tube 43 of quartz of at least 20 mm inner diameter is preferably used to contain a heated gas flow in the immediate surrounding vicinity of the fiber tow 42. While heating of the tow is required, the use of an insert tube is optional, and the process can work without it. The diameter of tube 43 or the shape of its cross-section may change, as long as it fits between the antennas 75. Any modification on this tube would have a limited impact on the EM field distribution and the efficiency of the process, as long as if it is made of fused quartz or any other material with a low loss tangent in the temperature range of interest.

Since the tube 43 is substantially transparent to microwaves, its presence theoretically does not affect the field distribution. Hence its removal should leave the process unchanged. However, its presence does provide at least two benefits: 1. It reduces heat transfer from the $N_2$ purge to the cavity (currently a thick block of stainless steel). 2. It prevents the off-gassing from the material to reach and condense on the walls of the cavity or in the waveguide system 52.

Example

As previously mentioned, the process is significantly enhanced with a thermal background. Processing with insufficient background temperature creates inter-filament arcing. Any type of heat source that will elevate the temperature of the process chamber in the 200° C.-400° C. range (ideally 350° C.) is helpful to make this process stable and free of arcing. The heating system can be of any kind, inside or outside the processing cavity, directly or indirectly heating the fiber. One suitable heating system selected for the inventive device is an inline gas heater that warms up the nitrogen purge gas, which is introduced via gas inlet 44. Gases are poor heat-transfer fluids in general and cannot be used efficiently to warm up the entire applicator. For this reason, a quartz tube 43 was inserted into the cavity. The quartz tube permitted the following:

First, it created very little perturbation of the EM field distribution in the cavity (indeed, fused quartz is almost transparent to the waves at the band and temperature of interest). Second, it substantially reduced the volume that had to be heated, confining it to a small space directly adjacent to the fiber tow 42. Third, it created a thermal insulator between the volume to be heated and the cavity walls 61, 62 (a massive block of stainless steel in this case).

The tube or structure 43 that is used does not have to be made of fused quartz or have a circular cross section. It can be made of any material that is transparent at the frequency and temperature of interest (low loss tangent), and its cross section can be of any shape. Applicants contemplate, for example, that in applicators designed to process multiple tows the transparent structure may have a rectangular cross section. But it could be more a complex shape, such as a liner that would mimic the internal shape of the cavity.

The MW Power Source with its Transmission Line

The concept of this applicator is to create a resonant cavity, tuned with the power source, in which a standing wave with high EM fields is generated and maintained in areas along the path of the fiber. All operation takes place at ambient pressure (760 Torr) for ideal integration into current industrial polymeric fiber conversion lines. Such a carbonization process occurs in a treatment volume where the nitrogen flow is heated with conventional heat sources up to 400° C. This process operates better at elevated fiber temperature in the current example (with a background temperature of 350-400° C.) because, as previously noted, the dielectric properties become lossier and coupling with the EM energy is thereby is improved. While 400° C. can be exceeded, the economic benefits begin to vanish with an increase in temperature of conventional heat sources.

The applicator 1 should preferably operate within a frequency band that is set aside for industrial application in most countries around the world (the so-called ISM bands) with a capital investment as low as possible. However, the inventive concept is in principle possible/efficient in any band from 1 MHz-300 GHz.

Those skilled in the art will appreciate that all physical dimensions of the applicator and its antenna system are frequency dependent. The choice of the band of operation has several consequences. In particular, lowering the frequency of operation implies:

1. lower coupling with the load (reduced efficiency);
2. larger equipment overall because the dimensions of the applicator scale with the operating wavelength;
3. more affordable power source (i.e., lower capital investment per Watt);
4. potential ease in obtaining uniform high field patterns of larger size, which could be beneficial for scalability.

On the other hand, operating at high frequencies implies the exact opposite effects, up to a frequency limit, where the material no longer couples to the EM field. Applicants determined that a system operating at 2.4-2.5 GHz represented a reasonable trade-off between coupling, power, price, and regulatory compliance. However, the invention is by no means limited to this frequency range.

Example

A common generator at 2.45 GHz can be used for this application. In this example, an oversized 3 kW generator based on magnetron technology [CoberMuegge, Reichelsheim, Germany] was selected and successfully operated with the aforedescribed applicator. Nonetheless, this type of generator is not necessarily optimal for this application because the Q factor of the cavity is maximized only for very narrow bandwidth (a few MHz), which is much narrower than the output bandwidth of the EM power source, which typically varies over +/−25 MHz. Any EM output at frequencies where Q is lower will be wasted.

The skilled artisan will appreciate that solid state power supplies may be more preferable for the following reasons:

First, the bandwidth of Applicants' cavity with a return loss lower than −20 db is in the range of a few MHz and rarely reaches 5 MHz, whereas the best tuning band with a return loss lower than −25 dB is usually no more than 1 MHz. These values are relatively small compared to the frequency of operation of a magnetron source and are the typical characteristic of narrow band circuits. This narrow band characteristic can be anticipated with the CEM and is observed on the physical setup using a vector network analyzer (VNA). This cavity configuration is therefore not ideal for using magnetron technology which cannot deliver a signal cleaner than 20 MHz full width at half maximum (FWMH). A solid-state generator can deliver a cleaner signal with an accuracy of 1 MHz, making it potentially more efficient.

Second, the best frequency of operation might shift by few MHz over time because of the variation with the dielectric properties and the material located in the cavity. If the dielectric properties can be efficiently monitored (via return loss), the operating frequency can be adjusted. The ideal system would allow a closed loop control of the frequency of operation based on the return loss measurement. Solid state generators can have this feature, but magnetrons do not. Magnetrons inherently operate about a fixed frequency. This frequency may slightly shift as a function of the output power and the device's temperature, but it is not controllable. This small frequency shift does not help in the process of carbonization.

Third, the life expectancy of magnetrons can be substantially affected by the operating conditions and rarely exceeds one year under continuous operation. Furthermore, the life expectancy of a magnetron can be shortened by random failure. On the other hand, the solid state supplies show significantly higher reliability with 10 times longer life expectancy.

Many suitable solid state power supplies are commercially available. Some examples include: model PTS-8 (Cellencor, Inc., Ankeny, IA); model GMS-200 (Sairem, 69150 Docines-Charpieu, France); model RIU256K0-40T (RFHIC Corporation, Republic of Korea); model MR1000D-200ML (Gerling Applied Engineering, Inc., Modesto, CA); and others.

Example

The transmission line is the subsystem that connects the generator to the applicator. In the current example, the transmission line comprises the following components:

- a single circulator directly connected to the magnetron on first port, a water-cooled dummy load on the second port, and the rest of the transmission line on the third and last port (all ports being WR340 sized);

an adaptor WR340 to 1⅝ inch circular wave guide tubing;

a 1⅝ inch tee to split the line at equal distance to each antenna; and,

1⅝ inch wave guide 53 tubing to each antenna port 53.

All of the microwave components up to the antenna port are not shown because these are all standard components familiar to those in the field of microwave heating, and may easily be changed and modified based on details of the particular power supply, available space on the production line, and location of utilities. Any microwave power supply and transmission line setup that delivers power to antenna ports 53 will be suitable for driving applicator 1.

A nitrogen purge was employed in the waveguide structure to prevent contamination from any off-gassing produced by the process. Note: the main purge of the process cavity is carried out by a separate port that is independent from transmission line's purge pathway.

The skilled artisan will appreciate that many other configurations are possible for the construction of the transmission line through routine experimentation and normal engineering practice. The main considerations are based on the following constraints:

impedance and insertion loss of each element;

power rating at the frequency band of interest;

management of the reflected power using appropriate circulator, dummy load, etc.; and, temperature rating (this is highly dependent on the structure of the design, the thermal properties of adjacent parts, and the design of the heat sources for the thermal background).

If the enclosure of the applicator is not directly heated (i.e., a "cold wall" applicator cavity), these constraints are limited to the electromagnetic consideration (the first three points above). This allows the use of coaxial cables instead of wave guides. If the fourth condition above is also satisfied, the choice between cables or any type of wave guide does not affect the process.

As in any EM system, tuning is a critical aspect that must be performed. With an appropriate setup design, and if all impedances are matched, the return loss can be as low as −30 dB. Achieving an advantageous matching while getting an appropriate high EM field pattern in the cavity is enabled by extensive use of computational electromagnetics (CEM) modeling. Despite several approximations, the model can help in predicting the bands of best tuning as a function of several parameters. The most important ones being the shape and the distance of the reflectors 61, 62. The shape and the distance are the two major parameters that should be explored with the CEM modeling. They define the shape of the applicator. Once these two parameters are fixed, further fine tuning must be achieved with other parameters kept variable with the final hardware, viz., the distance between the antennas 75, and the position of the adjustable wall 63 along X.

For the physical setup, tuning is conducted with a vector network analyzer (VNA). This step must be completed with care as the tuning is highly sensitive to the aforementioned variables. The adjustable wall position is the parameter for tuning the cavity at the beginning of the process. When properly set, the reflected power can be as low as −25 dB at the beginning of the process. Then, the band in tune might slightly shift to lower frequencies as the material is processed, until reaching a steady state. While the magnetron technology does not allow tracking this shift, the broadness of its signal keeps the process sustainable, as long as the best band of tuning remains in its band of operation.

Pattern of radiation and controlled asymmetry: The relative position of the adjustable wall 63 impacts not only the tuning between the generator and its load, but also the pattern of radiation inside the resonant cavity. This makes two conditions that must be satisfied simultaneously. When appropriately configured, the reflectors 61, 62 help concentrate the areas of highest EM field intensity along the X axes, on the path of the tow. Applicants' modeling and the experimental work showed that, with this given configuration (frequency of operation, dimensions, shape of the antennas and reflectors, etc.), the pattern of radiation along the X axis was mostly composed of two symmetric areas when the adjustable wall is set at the end of the cavity, or close to this extreme position (which makes the cavity completely symmetrical or quasi symmetrical). One pair of lower intensity areas exist relatively close to the central position O where the two antennas are located, and another pair of strong areas exist very close the entrance and the exit.

Further experimental work showed that symmetric EM field distribution along the X axis might not be desirable. Frequently, the tow is severed at the entrance because of the immediate exposure to a strong EM field. By reducing one of its dimensions, the cavity and the resulting field distribution become asymmetric. So in addition to providing a parameter for tuning adjustment, a second function of the adjustable wall 63 is to make the resonant cavity asymmetrical in the X direction. By making the cavity asymmetrical, the EM field also becomes asymmetric, and the first strong spot located close to the adjustable wall vanishes. This configuration allows the fiber tow 42 to experience a more gradual increase in the EM field while traveling through the cavity.

It will be appreciated that both end walls may be adjustable in some applications. Such a configuration would allow the user even more latitude to independently adjust the overall cavity length, field asymmetry, and position of the antenna structure relative to the center of the X axis.

The Fiber Delivery System

The final essential component to the success of this method is the use of precision fiber delivery. At room temperature and the frequency range of interest, the loss tangent of the OPF is very low. The material must reach an appropriate temperature, between 200° C. and 400° C., to be able to couple with the EM energy at the time of the exposure to the radiation. Additionally, the position, spread and tension of the fiber are important parameters. The position of the fiber must be controlled with precision: The tow must be aligned with X while being well centered between the two antennas (preferably Z=0±0.5 mm at any point). This position is mostly dictated by the field intensity distribution inside the cavity, which was predicted with the CEM modeling. Finally, the fiber must be under tension during the course of processing so that the proper balance between molecular relaxation (due to heat) and molecular orientation (due to tension) can be achieved.

Example

In one example of the invention, a single 50 k tow was processed continuously. When the fiber tow is spread, the width of this tow is approximately 20 mm. The typical line speed was set in the range of 1.1 ft/min to 2.4 ft/min, which corresponds to residence times in the cavity on the order of seconds. Applicants contemplate that because of the observed stability and homogeneity of this method, the existing cavity could have a larger processing capacity than the current ~20 mm width, which leads to the potential for the processing for multiple tows. Also, the format of the processed material could be in different shapes such as: fiber bundles, ropes, tows, plates, films, ribbons, etc. This is possible by proper design and configuration of the applicator. With these considerations, the present invention can be scaled in several ways:

First, the physical size of the reflectors 61, 62 could be enlarged, thereby permitting a greater processing width. A lower operating frequency would likely be required. Second, operating at higher resonant frequencies with the same cavity could enlarge the processing zone. Third, one could use multiple resonant frequencies, simultaneously or with duty cycles, to generate optimized mode distribution across the cavity for wider processing. Fourth, arrays of applicators may be arranged, inline and/or in parallel, to increase line speed and mass throughput.

Operating Examples and Test Results

The following examples present a series of results obtained with the invention. The following datasets were collected using a cavity designed to operate at 2.45 GHz. These results could vary with the dimension of the equipment and its frequency of operation. Consequently, the invention is not limited to the following examples, but can be modified by the skilled artisan through routine experimentation.

These tests were based on the continuous processing of feedstock consisting of a single 50 k filament tow of industrial commodity grade oxidized PAN fiber with a density of 1.37 g/cm$^3$. This oxidized material was subjected to treatment as described herein to become carbonized material (carbonized carbon fiber). Exemplary results will be described in the following order: The first example shows resistance measurements of the resulting carbonized fiber. The second example presents density measurements on a sample that was treated without the initial heating at 350° C. (thermal background). The third example is a data set of mechanical properties of multiple runs after complete carbonization of the fiber (the complete carbonization involves a process using the present invention followed by a treatment at higher temperature using a conventional furnace).

Example

In this example, OPF was fed through the quartz tube, and the system was warmed up until reaching a thermal background of ~325° C. The fiber was set in motion at a speed that gave a residence time in the chamber of approximately 1 minute. The MW power (2.45 GHz) was turned on to ~2 kW. This experiment was run for 20 minutes, and several meters of processed fiber were collected. A 3 m section of processed material was analyzed for resistance measurements and the data are presented in FIG. 3. The measured data shows an average resistance of ~1 kΩ, a value comparable to the conventional CF thermal conversion to a processing temperature of approximately 800° C. This clearly indicates that the invention can carbonize oxidized PAN fibers to a level further than what is typically present at the exit of the conventional LTC process (referring to FIG. 1).

For this project, the same oxidized feedstock PAN material was carbonized conventionally at different levels of carbonization temperatures for both carbonization stages (LTC and HTC individually). This provided a control baseline for comparison.

Figure 3:
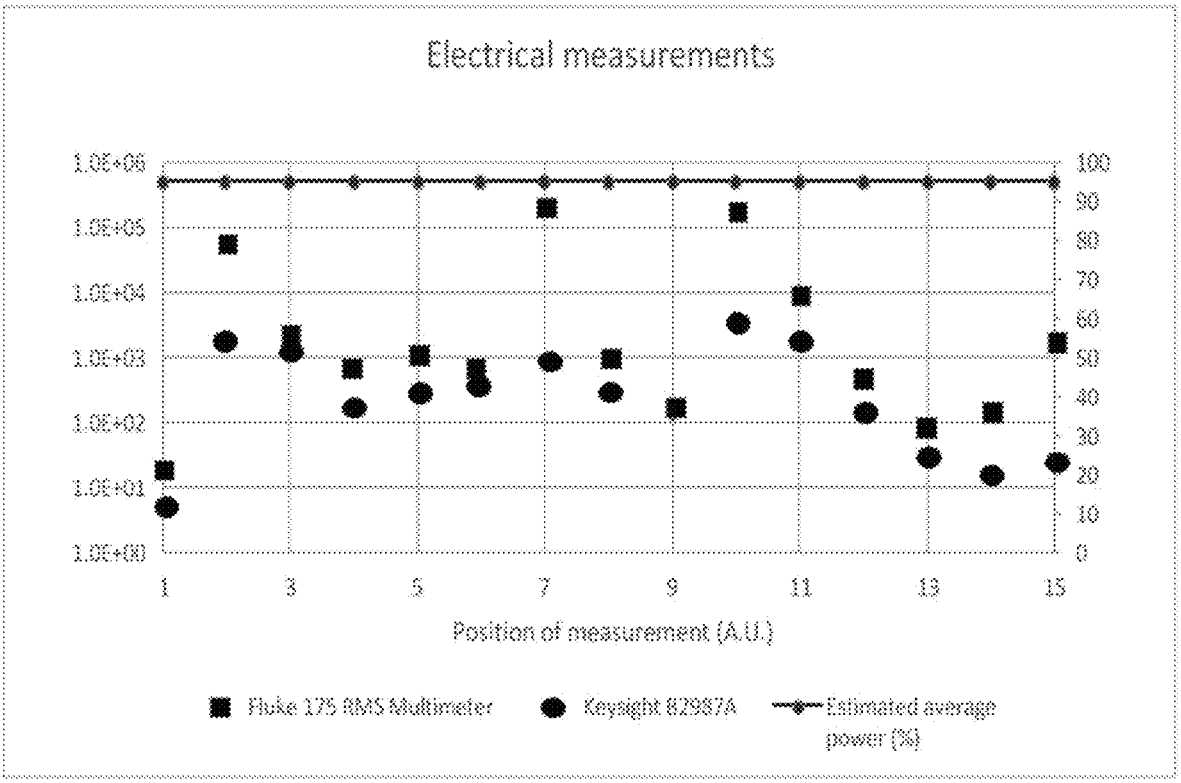
FIG. 3 is a plot of resistance measurements along the length of a fiber tow processed in accordance with some aspects of the invention.

As shown in FIG. 3, resistance measurement along the length of a processed fiber tow was undertaken. Two devices were used for these measurements: 1. a handset multimeter with copper prongs (Fluke 175 with a non-clamping fixture), and 2. a benchtop device (Keysight B2987A) connected to solid stainless-steel clamping blocks. The inter-electrode distance was constant at 50 mm for both systems. Each point is the average of three measurements. As expected, the trends of the two datasets are comparable. They both confirm that the material is becoming electrically conductive. Most of the measurements are around 1 kΩ, which indicates an equivalent conventional process temperature of 800° C. Note: the discrepancy between the two series of measurements is due to the efficiency of the clamping/contact between the tow filaments and the measurement probe.

Example

In this example, the system was run without the quartz tube and without the initial heating (thermal background). The MW power was set to ~2 kW, and the tow moved at a slightly faster speed so that the residence time was slightly shorter compared to the residence time used in the previous example. During this test, a sample of ~3 m was produced. The process was interrupted by the failure of the sample. Afterward, the density of the sample was analyzed by section of 600 mm and compared to the density of the feedstock material before processing (Table 2).

TABLE 2

Density of different sections of processed tow compared to that of the unprocessed feedstock

| | Section of sample | | | | | |
|---|---|---|---|---|---|---|
| | A | B | C | D | E | Feedstock |
| Length, m | 0.6 | 0.6 | 0.6 | 0.6 | 0.6 | |
| Density, g/cm$^3$ | 1.61 | 1.56 | 1.66 | 1.63 | 1.75 | 1.37 |

As presented in Table 2, the sample length was divided into five 0.6-m long sections (A to E) for density characterization. Visually, the samples appeared homogeneous with the exception of the last zone (E) that showed minor heat damage before a sharp cut caused by arcing between filaments. In this test, the power was maintained constant and no quartz tube was used. The average density of all 5 zones is 1.64 g/cm$^3$. For comparison, the density of the feedstock material is 1.37 g/cm$^3$, and a baseline value of 1.63 g/cm$^3$ is obtained with the same material exposed to a conventional LTC process with a residence time of 60 to 90 s.

The data show a large variation in the density values, indicating that the process was uncontrolled. The last section of the sample (E) shows a density value of 1.75 g/cm$^3$. This corresponds to the over-processed and damaged area. The root cause of the damage is inter-filament arcing. Indeed, arcing is very disruptive because it concentrates a locally high amount of energy capable of material ablation, and can damage the material very quickly. This condition must therefore be avoided. Applicants have discovered that one way to eliminate the arcing condition and preserve the workpiece from any damage or ablation is to apply a thermal background during the process to achieve enhanced coupling of the material to MW radiation. This also avoids localized overheating of the tow.

Incorporating the quartz tube and the preheating (thermal background) eliminates the problem of localized overheating, thereby providing excellent conditions for carbonization. The addition of the quartz tube further helps by reducing the volume to be heated, but is not strictly necessary and will depend on the specific construction of the equipment.

The foregoing example demonstrates the processing of OPF material to a density equal to or greater than 1.54 g/cm$^3$ with a residence time shorter than 60 s. The method preferably employs both an EM power source and an appropriate thermal background, so that the arcing phenomenon is suppressed and the process can sustainably produce continuous samples of pristine fiber.

Example

In this test, the quartz tube having a diameter larger than the tow spread (e.g., 20 mm), was installed in position and a thermal background of 350° C. was maintained via through the nitrogen purge using an inline gas heater. The EM setup was used to produce material at the level of a typical LTC step. A sample of pristine processed material was collected for more than one hour at 12 different processing parameters. The two main variables explored were residence time and temperature of the inline-heater. All residence times were maintained under one minute (60 s>$RT_4$>$RT_3$>$RT_2$>$RT_1$) and three temperatures were explored (150° C.<$T_1$<$T_2$<$T_3$<400° C.). The total length of this material was then HTC carbonized in a separate conventional furnace at a single process condition. Table 3 shows the mechanical properties (and their standard deviations) of pristine and homogeneous samples after HTC carbonization. It serves to emphasize that the invention is primarily intended to replace the conventional LTC step.

TABLE 3

Mechanical properties (tensile strength) achievable with the final product (fully carbonized fiber) using the EM carbonization process for the LTC stage and, subsequently, a conventional HTC process.

| Sample | Density, g/cm$^3$ | Diameter, μm | S.D. | Tensile strength, ksi | S.D. |
|---|---|---|---|---|---|
| 1 | 1.8032 | 8.05 | 0.35 | 348.7 | 77.5 |
| 2 | N/A | 8.2 | 0.41 | 303 | 87.5 |
| 3 | 1.7924 | 8.44 | 0.74 | 356.6 | 135.3 |
| 4 | N/A | 8 | 0.8 | 254.2 | 88.9 |
| 5 | N/A | 8.4 | 0.53 | 333 | 149.8 |
| 6 | N/A | 8.22 | 0.63 | 293 | 91.7 |
| 7 | N/A | 8.42 | 0.46 | 331.3 | 125 |
| 8 | N/A | 8.09 | 0.62 | 354.6 | 97.6 |
| 9 | N/A | 8.06 | 0.72 | 263.6 | 132.8 |
| 10 | N/A | 8.42 | 0.46 | 331.3 | 125 |
| 11 | 1.8138 | 8.91 | 0.63 | 340.2 | 101.7 |
| 12 | 1.8135 | 8.73 | 0.56 | 285.5 | 98.5 |

Mechanical properties (modulus and strain) achievable with the final product (fully carbonized fiber) using the EM carbonization process for the LTC stage and, subsequently, a conventional HTC process.

| Sample | Modulus, Msi | S.D. | Strain, % | S.D. | Temp. | Objective period |
|---|---|---|---|---|---|---|
| 1 | 23.42 | 1.84 | 1.49 | 0.28 | $T_1$ | $RT_4$ |
| 2 | 22.73 | 2.76 | 1.4 | 0.32 | $T_1$ | $RT_3$ |
| 3 | 24.88 | 3.83 | 1.42 | 0.47 | $T_1$ | $RT_2$ |
| 4 | 21.42 | 2.59 | 1.22 | 0.43 | $T_1$ | $RT_1$ |
| 5 | 25.44 | 3.45 | 1.29 | 0.51 | $T_2$ | $RT_4$ |
| 6 | 22.79 | 3.31 | 1.27 | 0.27 | $T_2$ | $RT_3$ |
| 7 | 23.11 | 1.84 | 1.48 | 0.55 | $T_2$ | $RT_2$ |
| 8 | 23.64 | 2.42 | 1.48 | 0.32 | $T_3$ | $RT_4$ |
| 9 | 22.31 | 3.61 | 1.13 | 0.44 | $T_3$ | $RT_3$ |
| 10 | 23.11 | 1.84 | 1.48 | 0.55 | $T_3$ | $RT_2$ |
| 11 | 25.14 | 1.73 | 1.39 | 0.43 | $T_3$ | $RT_1$ |

Table 3 shows the mechanical properties achievable with the final product (fully carbonized fiber) using the EM carbonization process at the LTC stage, followed by a conventional HTC process. A group of 20 to 25 filaments was tested for the 12 samples (single filament tensile test). All samples were processed with the same conditions during conventional HTC. At low temperature carbonization, using the present invention, temperature and residence time are the evaluated parameters (the power level of the RF generator was kept unchanged at ~2 kW). The two last columns indicate the temperature of the in-line heater and residence time. All residence times are shorter than 60 seconds with $RT_4$ being relatively close to a minute and $RT_4$>$RT_3$>$RT_2$>$RT_1$. No attempt was made to optimize all of the process parameters during this set of tests.

Coupled with a subsequent conventional HTC stage, the inventive method produces carbon fiber with mechanical properties on average around 2.2 GPa (315 ksi) for the tensile strength, and 160 GPa (23.4 Msi) for the modulus. These mechanical properties are obtained without an optimization process. With this method, the data shows that the residence time has a low impact on the mechanical properties in the studied range. The data shows the mechanical properties (both tensile strength and modulus) of the fiber treated with a short residence time are ~5% lower on average than the mechanical properties of the fiber treated with a long residence time, even though the residence time was reduced by ~50%.

The following examples describe in greater detail the design of one example of the inventive apparatus as illustrated schematically in FIGS. 4-10. The enclosed cavity is electromagnetically shielded except for the small leakage of MW energy through the slits provided for the fiber tow to enter and exit. If desired, the slits can be provided with optional microwave chokes (not shown). These are normally not required if the power supply operates on a designated ISM band.

Example

Figure 4:
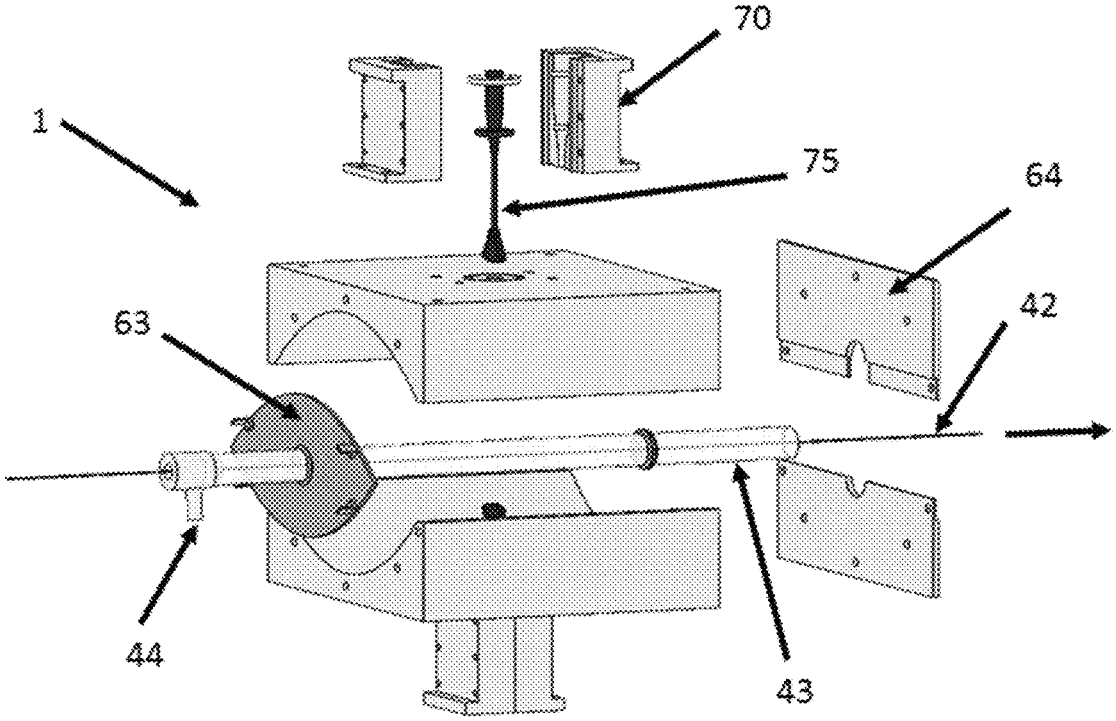
FIG. 4 is an exploded view of an applicator in accordance with some aspects of the invention.

FIG. 4 presents an exploded view of the applicator 1. The 50 k tow of oxidized feedstock material 42 travels from left to right through the quartz tube 43. The inlet of the tube has a port 44 where the supplemental inline heated gas is connected (the gas heater, not shown, may be of any suitable type as are well known in the art). One vertical wall 64 is fixed, and the opposite wall is adjustable (63 on the entrance side). This adjustable wall can slide between the reflectors, creating an asymmetry in the cavity length.

Example

Figure 5:
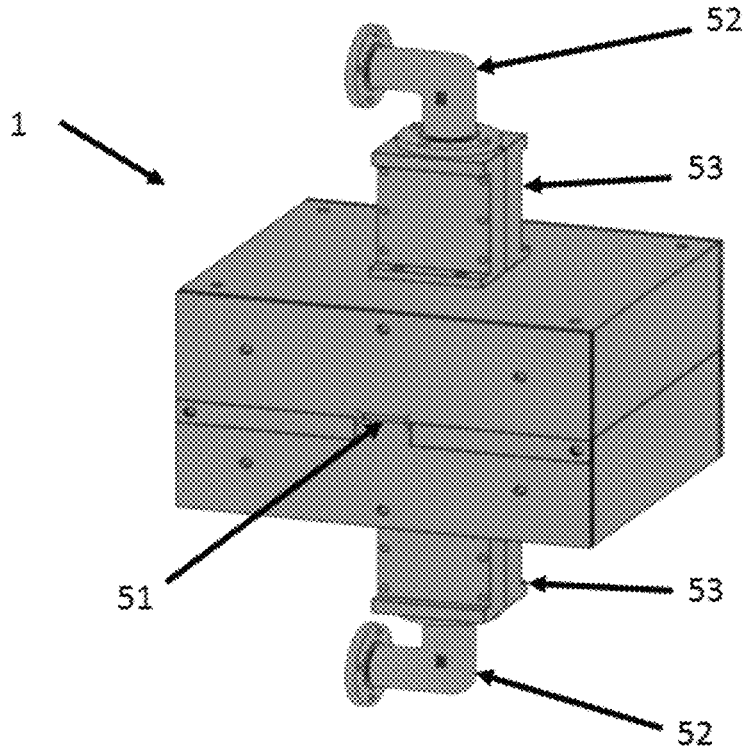
FIG. 5 is a perspective view of a closed applicator and microwave power connections in accordance with some aspects of the invention.

FIG. 5 presents an isometric view of the applicator with closed doors. In this example, the applicator is stainless steel. Brass elbows 52 are the connection points between the MW transmission line (not shown) and the antennas 75. In this drawing, the applicator is closed and the adjustable wall 63 is not shown.

Example

Figure 6:
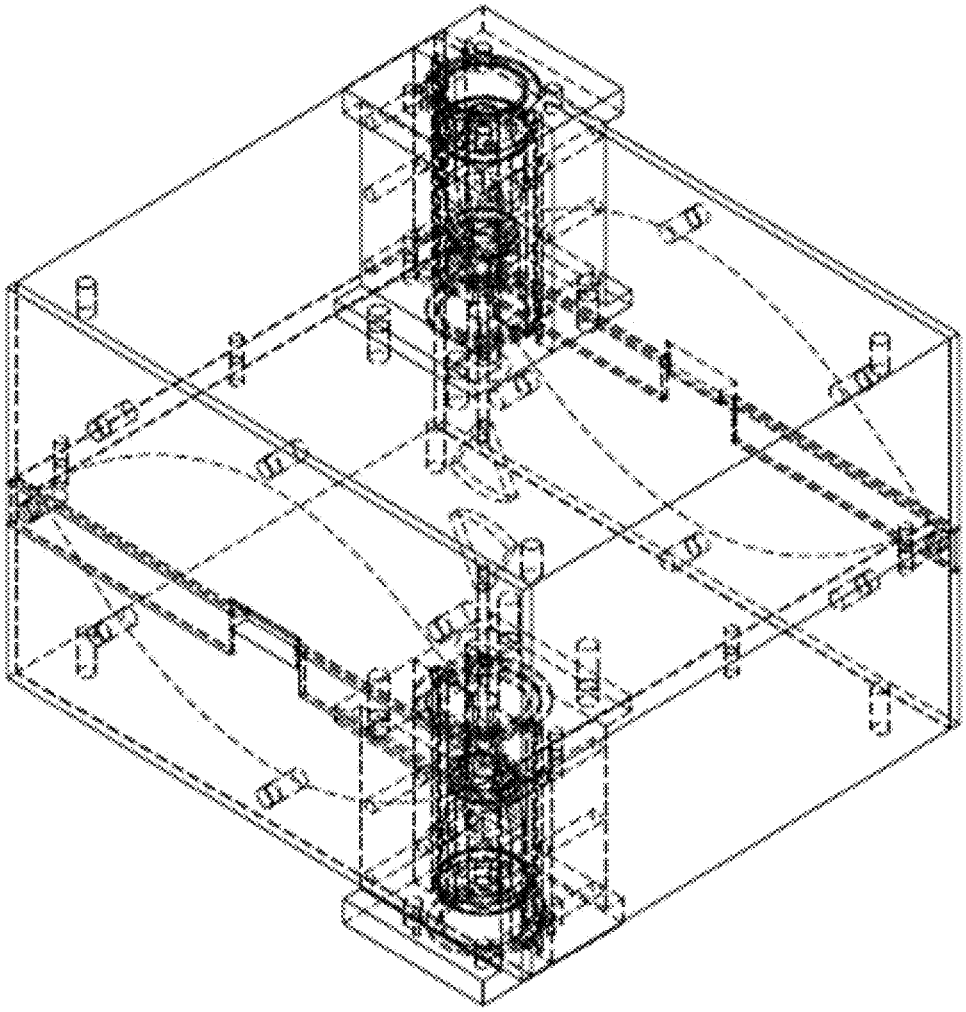
FIG. 6 is a perspective view of an applicator in accordance with some aspects of the invention, where the internal outline of the cavity and the antenna structure are shown as dashed lines.

FIG. 6 illustrates schematically the general layout of the applicator 1. The parabolic reflector 61, 62 and the antennas 75 are represented with dashed lines. The optional tube 43, preferably made of fused quartz, is not shown on this drawing.

Example

Figure 7A:
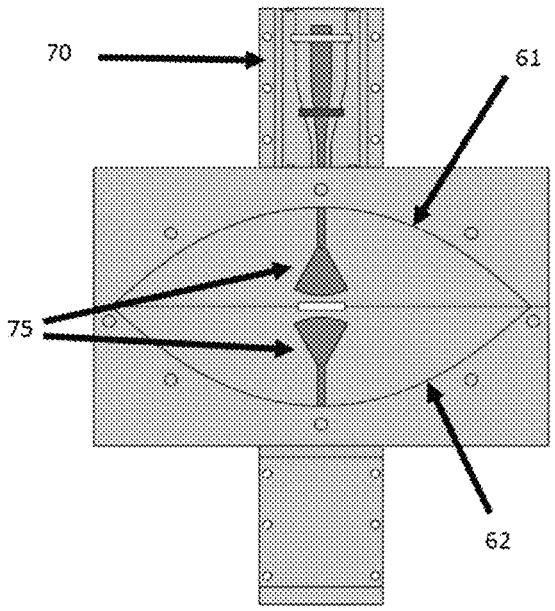
FIGS. 7A-B present an end view (FIG. 7A) and perspective view (FIG. 7B) of a cavity adapted to have one fixed end wall and one sliding end wall so that the length of the cavity may be adjusted in accordance with some aspects of the invention.
Figure 7B:
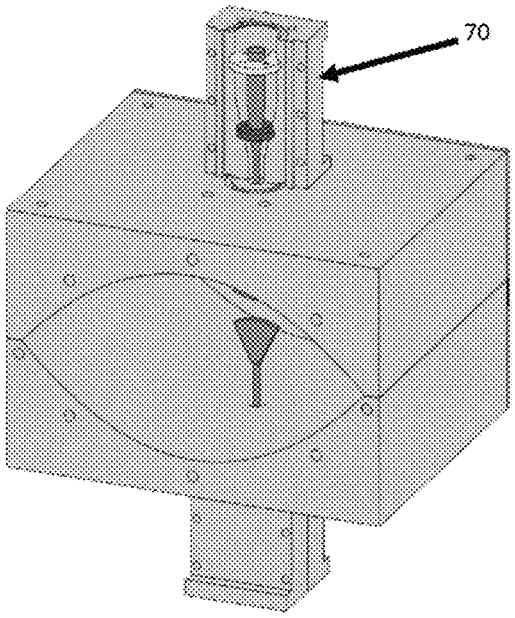

FIG. 7 shows schematically an end view (FIG. 7A) and isometric view FIG. 7B of the cavity with the adjustable wall removed. The adjustable wall is a vertical plate in which the upper and the lower edges closely fit the two paraboloid surfaces of reflectors 61, 62. The length of the antennas 75 is adjustable by replacing the standoffs 82 along the narrowest part of antenna with standoffs that are longer or shorter. The fixture 70 that holds the upper antenna 75 is shown opened for clarity. When used with a tubular quartz insert 43, the separating distance between the two antennas 75 will be adjusted to allow enough clearance for that insert. This distance should be at least equivalent to the vertical thickness of the insert increased by a short clearance in the millimeter range or so.

Those skilled in the art will appreciate that all dimensions given here are simply illustrative of one working system designed for operation at 2.45 GHz, and are therefore non-limiting, as the invention may be adapted to use a power supply operating on another frequency.

Example

Figure 8A:
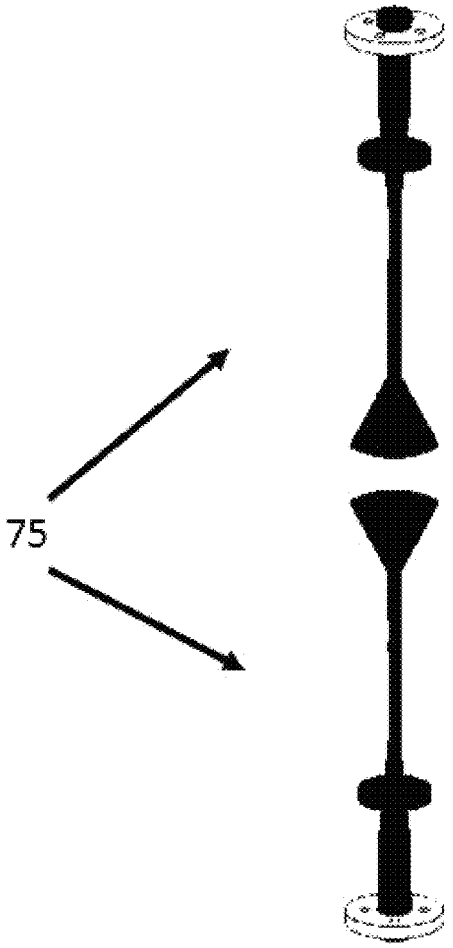
FIGS. 8A-B present an inclined view (FIG. 8A) and an elevation view (FIG. 8B) of an antenna structure in accordance with some aspects of the invention. The fiber tow passes between the two halves of the antenna structure.
Figure 8B:
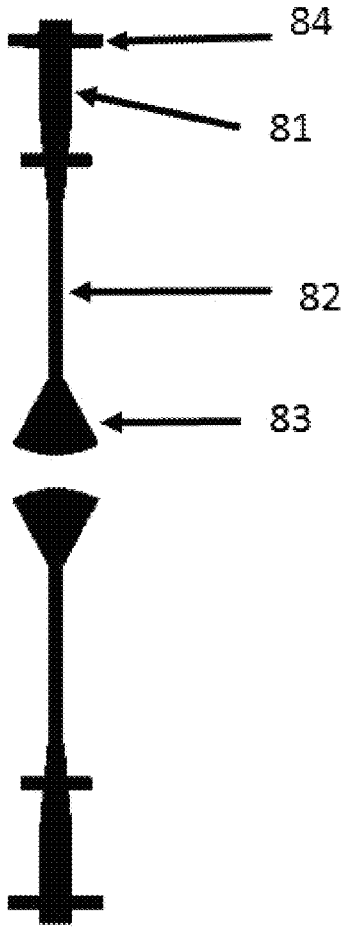

FIG. 8 schematically illustrates oblique and elevation views of the antennas 75 with the supporting insulating washers 84 as they are inserted in the applicator. The washers 84 are preferably made from a temperature-resistant dielectric material such as MACOR® machinable glass ceramic (Corning Incorporated, Corning, NY). The antennas 75 are made of stainless steel in three parts: a connector 81 (tapered section), a standoff 82 (straight section), and a radial stub 83. The radial stub is a flat plate whose thickness is the same as the diameter of standoff section 82. The end of stub 83 is rounded to eliminate concentrations of the electric field and reduce the potential for arc formation. It will be appreciated that other radii might be selected, e.g., when operating at a different frequency, using a wider tow, or adjusting to other engineering changes.

Example

FIG. 9 presents a side view of one antenna 75. The central straight section (between the radial stub and the connector section) 82 is a standoff that can be interchanged with other lengths to allow the user to adjust the position of stub 83 relative to the fiber tow. The thickness of the radial stub 83 is the same as the diameter of standoff 82. The uniform thickness eliminates steps and corners that might lead to the initiation of unwanted arcs. The connection to the 1⅝ inch waveguide brass elbow is a simple press fit. The tapered section is the female side of the connection. The 1⅝ inch elbow is the male side.

Example

FIG. 10 presents a plan view of one antenna viewed from above. The connector section 81 has a cylindrical cavity 85 in its upper surface. This cavity forms a close fit female connection to mate with the pin of a 1⅝ inch wave guide.

Example

Figure 11:
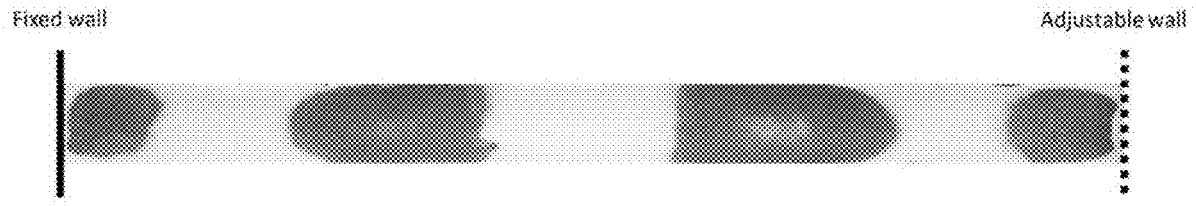
FIG. 11 presents a map of the electromagnetic field distribution along the fiber, imaged using thermal paper.

FIG. 11 presents the spatial distribution of the EM field along the fiber. The adjustable wall is set to its maximal outer position, on the right side of both configurations and is represented by a dashed line. A theoretical representation of the distribution of the E-field based on the calculation of a CEM model suggested two areas of maximum power, one on either side of the center of the cavity. FIG. 11 shows the results of an experiment in which the fiber was replaced by a wet thermal paper that is exposed to the EM field in CPEC-3. The dark regions represent the locations where the E-field is strong enough to elevate the temperature of the wet thermal paper, unveiling the effective processing areas of the setup. It is observed that the locations of the hot regions match with the predictions of the CEM modeling. However, the regions close to the walls, despite being smaller, appears as being almost as intense as the central regions.

In addition to the foregoing specific examples, the skilled artisan will readily appreciate that many modifications and variations of the invention may be contemplated within the scope of the invention as claimed.

The applicator cavity and the antennas may be constructed from any suitable metal alloys by any convenient fabrication processes as are well known in the art. Nonmetallic components, e.g., the antenna washers and the insert tube, may be fabricated from any suitable insulating material having appropriate dielectric properties such as glass, glass-ceramics, ceramic composites, and machinable glass-ceramics.

The carbon fiber precursor material may be cellulose, pitch-based fibers including isotropic and mesophase pitch, rayon, polyacrylonitrile (PAN), nylon-based fibers, and other polymeric fibers and may be subjected to conventional pretreatments, including prestretching, and stabilization in an oxidizing environment at 200-400° C. for several hours. After low temperature carbonization in the EM process described in the various examples, the carbon fiber may be subjected to further process steps that may include: high temperature carbonization, typically between 800 and 1500° C.; graphitization treatment typically between 2000 and 3000° C.; surface treatment in an electrolytic or acidic bath; and coating with a sizing material.

The EM energy may be provided by any suitable power source, which may include: magnetrons, klystrons, gyrotrons, traveling wave tubes, and solid state power amplifiers. The power supply may operate at any suitable frequency; when operating at frequencies outside of the recognized ISM bands, RF chokes may be installed on the end slits to reduce electromagnetic emissions to comply with communications regulations.

The applicator 1 and its associated power supply and heated gas supply forms a process module intended to replace the conventional radiant heated low temperature carbonization stage (outlined by the dashed box in FIG. 1) in a continuous carbon fiber production line. It is therefore necessary for the fiber tow 42 to move through this process stage at the same speed as it moves through the production line generally. The skilled artisan will appreciate that by routine experimentation and engineering, the variables of chamber temperature, microwave power, and the physical dimensions of the cavity may be adjusted so that the prevailing speed of the fiber tow will allow adequate residence time in the applicator cavity. Furthermore, Applicants' experimental results suggest that the invention performs LTC somewhat more effectively that the conventional process, and in some cases may allow the next process stage (HTC) to be shortened somewhat, thereby providing further efficiency gains for the total production process.

We claim:

1. An apparatus to partially carbonize stabilized carbon fiber precursor materials comprising:

a source of electromagnetic energy of a selected power and frequency;

a tunable resonant cavity including an antenna structure to localize the electromagnetic energy on the precursor material; and, openings in both ends of the cavity, so that the precursor material passes through the cavity as a continuous fiber tow in a selected atmosphere at atmospheric pressure.

2. The apparatus of claim 1 wherein the source of electromagnetic energy comprises a device selected from the group consisting of: magnetrons, klystrons, gyrotrons, traveling wave tubes, and solid state power amplifiers.

3. The apparatus of claim 1 wherein the frequency of electromagnetic energy is between 1 MHz and 300 GHZ.

4. The apparatus of claim 3 wherein the frequency of electromagnetic energy comprises a selected bandwidth about a center frequency of 2.45 GHz.

5. The apparatus of claim 1 wherein the tunable resonant cavity comprises two facing paraboloidal surfaces and two planar end surfaces, and wherein at least one of the planar end surfaces is movable so that the cavity length and asymmetry relative to the antenna structure may be adjusted.

6. The apparatus of claim 1 wherein the antenna structure comprises two identical antennas facing each other on opposite sides of the fiber tow and spaced apart equidistant from the fiber tow.

7. The apparatus of claim 6 wherein each antenna comprises an interchangeable cylindrical member by the interchanging of which the overall length of the antenna may be adjusted, and the cylindrical member is terminated in a planar stub having a selected radius of curvature on the edge facing the opposite antenna.

8. The apparatus of claim 1 wherein the openings on both ends of the cavity further comprise RF chokes to reduce the leakage of electromagnetic energy from the resonant cavity.

9. The apparatus of claim 1 further comprising a secondary heating system to control the thermal background of the process to increase the permittivity of the precursor material so that the material will absorb the electromagnetic energy efficiently, and the secondary heating system comprises a source of heated gas at 200 to 400° C. that passes through the cavity and heats the precursor material.

10. The apparatus of claim 9 wherein the secondary heating system further comprises a tubular dielectric structure surrounding the fiber tow and containing the heated gas in proximity to the tow of precursor material.

11. An apparatus to partially carbonize stabilized carbon fiber precursor materials comprising:

a source of electromagnetic energy of a selected power and frequency;

a tunable resonant cavity including an antenna structure to localize the electromagnetic energy on the precursor material;

a dielectric tube disposed within the antenna structure, through which the precursor material passes as a continuous fiber tow in a selected atmosphere at ambient pressure; and, a system to control the thermal background of the process to increase the permittivity of the precursor material so that the material will absorb the electromagnetic energy.

12. The apparatus of claim 11 wherein:

the source of electromagnetic energy comprises a device selected from the group consisting of: magnetrons, klystrons, gyrotrons, traveling wave tubes, and solid state power amplifiers; and, the frequency of electromagnetic energy is between 1 MHz and 300 GHZ.

13. The apparatus of claim 12 wherein the frequency of electromagnetic energy comprises a selected bandwidth about a center frequency of 2.45 GHz.

14. The apparatus of claim 11 wherein the tunable resonant cavity comprises two facing paraboloidal surfaces and two planar end surfaces, and wherein at least one of the planar end surfaces is movable so that the cavity length and asymmetry relative to the antenna structure may be adjusted.

15. The apparatus of claim 11 wherein:

the antenna structure comprises two identical antennas facing each other on opposite sides of the fiber tow and spaced apart equidistant from the fiber tow; and, each identical antenna comprises an interchangeable cylindrical member by the interchanging of which the overall length of the antenna may be adjusted, and the cylindrical member is terminated in a planar stub having a selected radius of curvature on the edge facing the opposite antenna.

16. The apparatus of claim 11 wherein the openings on both ends of the cavity further comprise RF chokes to reduce the leakage of electromagnetic energy from the resonant cavity.

17. The apparatus of claim 11 wherein the secondary heating system comprises a source of heated gas at 200 to 400° C. that passes through the dielectric tube and heats the precursor material.

18. A method to partially carbonize stabilized carbon fiber precursor materials comprising the steps of:

providing a source of electromagnetic energy of a selected power and frequency;

providing a tunable resonant cavity including an antenna structure to localize the electromagnetic energy on the precursor material;

passing stabilized carbon fiber precursor material through the resonant cavity and through the antenna structure so that the precursor material is exposed to the electromagnetic energy in the selected atmosphere; and, controlling the thermal background of the process to increase the permittivity of the precursor material so that it will absorb the electromagnetic energy.

19. The method of claim 18 further comprising the step of:

maintaining the fiber tow in a selected state of tension as the fiber tow is processed.

20. The method of claim 18 wherein:

the antenna structure comprises two identical antennas facing each other on opposite sides of the fiber tow and spaced apart equidistant from the fiber tow; and, each identical antenna comprises an interchangeable cylindrical member by the interchanging of which the overall length of the antenna may be adjusted, and the cylindrical member is terminated in a planar stub having a selected radius of curvature on the edge facing the opposite antenna.

* * * * *